US005896921A

United States Patent [19]

Lee

[11] Patent Number: 5,896,921

[45] Date of Patent: Apr. 27, 1999

[54] INDOOR UNIT OF AN AIR CONDITIONER

[75] Inventor: Sang-Oh Lee, Seoul, Rep. of Korea

[73] Assignee: Daewoo Electronics Co., Ltd., Rep. of Korea

[21] Appl. No.: 08/863,400

[22] Filed: May 27, 1997

[51] Int. Cl.[6] ..... F28D 1/047

[52] U.S. Cl. ..... 165/149; 165/122; 165/145; 165/151

[58] Field of Search ..... 165/149, 151, 165/122, 67, 150, 144, 145; 62/525

[56] References Cited

U.S. PATENT DOCUMENTS

| | | | |
|---|---|---|---|
| 2,118,206 | 5/1938 | Kritzer et al. | 165/150 X |
| 2,255,969 | 9/1941 | Franco-Ferreira | 165/67 |
| 2,354,131 | 7/1944 | Larkin | 165/149 X |
| 3,028,149 | 4/1962 | Pellmyr | 165/149 X |
| 4,186,474 | 2/1980 | Hine | 165/144 X |
| 4,580,623 | 4/1986 | Smitte et al. | 165/150 |
| 4,903,763 | 2/1990 | Laveran et al. | 62/525 X |
| 5,259,206 | 11/1993 | Dankowski | 165/122 X |
| 5,564,495 | 10/1996 | Yoshihashi et al. | 165/122 |
| 5,573,059 | 11/1996 | Hamamoto et al. | 165/122 X |
| 5,575,326 | 11/1996 | Asami et al. | 165/122 X |

FOREIGN PATENT DOCUMENTS

| | | | |
|---|---|---|---|
| 309195 | 12/1990 | Japan | 165/151 |
| 68921 | 6/1992 | Japan | 165/122 |
| 95-6368 | 3/1995 | Rep. of Korea . | |

*Primary Examiner*—Leonard Leo
*Attorney, Agent, or Firm*—Pillsbury Madison & Sutro, LLP

[57] ABSTRACT

Disclosed is a heat exchanger for an indoor unit of an air conditioner being easier to make and having an improved efficiency of heat exchange by enlarging an area of the heat exchanger, which makes contact with air in a room. The heat exchanger for the indoor unit of the air conditioner comprises a first fin assembly for absorbing a heat from air in a room, a second fin assembly which is adjacent to an upper portion of the first fin assembly and spaced by a predetermined distance with respect to the first fin assembly, for absorbing a heat from air in the room, a plurality of refrigerant pipes which extend through the first fin assembly and the second fin assembly, for supplying a pathway for refrigerant, and a connecting member for connecting the first fin assembly and the second fin assembly with each other so that the second fin assembly is secured to the first fin assembly. The first fin assembly and the second fin assembly are made separately and connected by the connecting member so as to enlarge an area of heat exchange, thereby improving an efficiency of heat exchange.

5 Claims, 6 Drawing Sheets

130

INDOOR UNIT OF AN AIR CONDITIONER

BACKGROUND OF THE INVENTION

1. Field of the Invention

The present invention relates to an air conditioner, and more particularly to an indoor unit of the air conditioner which has an improved heat exchanger to improve a cooling efficiency of the air conditioner.

2. Description of the Prior Art

In general, an air conditioner is a product for satisfying a desire of human beings to live in a more comfortable environment of a room, and is used for controlling and maintaining the air of the room.

The air conditioner typically includes a compressor for compressing an evaporated refrigerant, a condenser for absorbing a heat from a compressed refrigerant and discharging the heat to an atmosphere so that the refrigerant can be liquefied, an expansion valve for reducing a pressure of the liquefied refrigerant and expanding the refrigerant, and an evaporator for absorbing a heat from an air of a room and evaporating the refrigerant. The devices are connected to each other by means of pipes which create a refrigerant pathway. The refrigerant undergoes phase changes while being repeatedly circulated through the pipes connecting the devices of the air conditioner to each other, thereby absorbing the heat from the air of the room and discharging the heat to the atmosphere.

The compressor, the condenser, and the expansion valve of the air conditioner are mounted in an outdoor unit thereof, and the evaporator of the air conditioner is mounted in an indoor unit. The evaporator and condenser are used as heat exchanger for absorbing the heat by means of the refrigerant and discharging the heat from the refrigerant, wherein since the condenser is mounted in the outdoor unit of the air conditioner, the condenser is not restricted with respect to a size, whereas since the evaporator is mounted in the indoor unit of the air conditioner, the evaporator is restricted with respect to the size in consideration of the heat exchange efficiency and the aesthetic quality of the indoor unit of the air conditioner.

Accordingly, various efforts for reducing the size of the indoor unit of the air conditioner and improving the heat exchange efficiency of the heat exchanger have been recently tried. One method for reducing the size of the indoor unit is bending once a fin assembly of the heat exchanger at a predetermined angle. In this case, the height of the heat exchanger is somewhat lowered so that the total size of the indoor unit can be reduced. An other method for reducing the size of the indoor unit is bending twice a fin assembly of the heat exchanger. In this case, the fin assembly is bent to form an obtuse angle between the lower portion and the intermediate portion thereof and to form an acute angle between the intermediate portion and the upper portion thereof so as to have an upside down V shape. Accordingly, even though the heat exchange efficiency of the heat exchanger is not reduced, the total size of the indoor unit can be further reduced since bending the fin assembly twice rather than bending the fin assembly once can reduce the height of the heat exchanger.

Korean Patent laid-open publication 95-6368 filed by Kabushiki Kasha Fagots General on May 20, 1994 discloses an indoor unit of an air conditioner which can be easily cleaned and has a compact size.

FIG. 1 is an exploded perspective view of an indoor unit of an air conditioner having a heat exchanger according to the Korean patent laid-open publication, and FIG. 2 is a cross-sectional view of the indoor unit of the air conditioner having the heat exchanger in FIG. 1. Referring to FIGS. 1 and 2, indoor unit 10 of the air conditioner according to the Korean patent laid-open publication of Fagots General includes a frame body 11, a front cover 12 incorporated with frame body 11 and having air inlets 19 and 20 at the upper surface and the front surface, respectively and an air outlet 21 at the lower portion of the front surface, a filter 13 which is disposed at the front surface of front cover 12, for filtering dust from an air sucked through air inlets 19 and 20, a sucking grille 14 removably attached to the front surface of front cover 12, a heat exchanger 15 which is arranged in frame body 11 and is bent twice to have an upside down V shape at the upper portion, for absorbing a heat from the air sucked in frame body 11, and a blower 16 arranged between heat exchanger 15 and a side wall of frame body 15.

An air pathway chamber 18 is defined in frame 17 of frame body 11. Blower 16 sucks the air of the room through sucking grille 14, filter 13, and air inlets 19 and 20 of front cover 12, and discharges through air outlet 21 the air which passes through heat exchanger 15 and flows into air pathway chamber 18.

In indoor unit 10 of the air conditioner of Fagots General according to the Korean Patent laid-open publication, heat exchanger 15, which is bent twice to have the upside down V shape at the upper portion thereof, is arranged in air pathway chamber 18 connecting air inlets 19 and 20 and air outlet 21 of front cover 12 to each other, and blower 16 is arranged between the fin assembly of heat exchanger 15 and the side wall of frame body 11, thereby reducing the height of indoor unit 10 of air conditioner.

However, there are problems in that since heat exchanger 15 mounted in indoor unit 10 of air conditioner of Fagots General must be bent twice, it is difficult to make heat exchanger 15, and since heat exchanger 15 is bent in the upside down V shape at the upper portion, the bending portion at the upper portion of heat exchanger 15 is easily damaged by a small outer impact.

SUMMARY OF THE INVENTION

The present invention has been made to overcome the above described problems of the prior art. It is an object of the present invention to provide a heat exchanger of an indoor unit of an air conditioner which can be made easily and in which an area of the heat exchanger can be enlarged so that it can be possible to improve a heat exchanging efficiency thereof.

To accomplish the above object of the present invention, there is provided a heat exchanger for an indoor unit of an air conditioner comprising:

- a first fin assembly which is bent at a position adjacent to a lower end, for absorbing heat from air of a room;
- a second fin assembly which is adjacent to an upper end of the first fin assembly and spaced apart from the first fin assembly by a predetermined distance, for absorbing heat from air of the room;
- a first refrigerant pipe for supplying a circulation pathway for refrigerant, the first refrigerant pipe extending through a lower portion of the first fin assembly and connecting fin plates of the first fin assembly to each other;
- a second refrigerant pipe for supplying a circulation pathway for refrigerant, the second refrigerant pipe extending through an upper portion of the first fin assembly and connecting fin plates of the first fin assembly to each other;

a third refrigerant pipe for supplying a circulation pathway for refrigerant, the third refrigerant pipe extending through the second fin assembly and connecting fin plates of the second fin assembly to each other;

a refrigerant supplying pipe for supplying the refrigerant to the first, the second, and the third refrigerant pipe, the refrigerant supplying pipe being connected at a first end to refrigerant inlets of the first, the second, and the third refrigerant pipes and being connected at a second end to an expansion valve;

a refrigerant discharging pipe for discharging the refrigerant from the first, the second, and the third refrigerant pipes to a compressor, the refrigerant discharging pipe being connected at a first end to refrigerant outlets of the first, the second, and the third refrigerant pipes and being connected at a second end to the compressor; and a connecting means for connecting the first fin assembly and the second assembly with each other, the connecting means being secured to both sides of the first fin assembly and the second fin assembly.

The connecting means is a steel plate having a thickness of 1 mm and a width equal to that of the fin plates of the first fin assembly and the second fin assembly.

A lower portion of the connecting means is bent at a position corresponding to a bending position of the first fin assembly, and an upper portion of the connecting means is bent at an acute angle to form an upside down V shape.

The connecting means includes a plurality of extensions expanding vertically to a surface of the connecting means from a first edge thereof and having a thruhole formed at a center portion of each extension, and the extensions are secured to the first fin assembly.

The connecting means also includes a fixing plate attached at a predetermined position on a second edge and having a thruhole formed at a center portion thereof, the fixing plate is secured by a fixing member to a body of the indoor unit so that the first fin assembly and the second fin assembly are secured to the body of the indoor unit.

The connecting means has a plurality of thruholes equal in number to a number of thruholes formed in each fin plate of the first fin assembly and the second fin assembly, and a center axis of each thruhole is coincident with a center axis of each thruhole formed in each fin plate.

The first fin assembly and the second fin assembly are comprised of a plurality of fin plates which respectively have a thickness of 0.12 mm and a width of 25 mm, and have two row of the thruholes formed in a zigzag manner, and have a cylindrical guide portion protruding at edge of each thruhole, and the guide portion guides the first, the second, and the third refrigerant pipes.

The first fin assembly and the second fin assembly are made separately, and the first fin assembly is higher in height than the second assembly.

As described above, in the heat exchanger of the indoor unit of the air conditioner according to the present invention, there is an advantage in that the first fin assembly and the second fin assembly are separately made and are connected by the connecting means to each other so that it is easy to make the heat exchanger and a length of a manufacturing process thereof is reduced with respect to a bending process according to the conventional art.

Furthermore, there is an advantage in that since a heat exchanging area of the heat exchanger is enlarged and an efficiency of the heat exchanger is increased, a total refrigerating efficiency of the air conditioner can be improved.

BRIEF DESCRIPTION OF THE DRAWINGS

The above object and other advantages of the present invention will become more apparent by describing in detail the preferred embodiment thereof with reference to the attached drawings, in which:

FIG. 6A and FIG. 6B show one of connecting members which connect a first fin assembly and a second fin assembly of the heat exchanger according to the embodiment of the present invention with each other, wherein FIG. 6A is a plan view of a connecting member and FIG. 6B is a side view of the connecting member.

DESCRIPTION OF THE PREFERRED EMBODIMENTS

Hereinafter, a preferred embodiment of the present invention will be described in detail with reference to the accompanying drawings.

Figure 1:
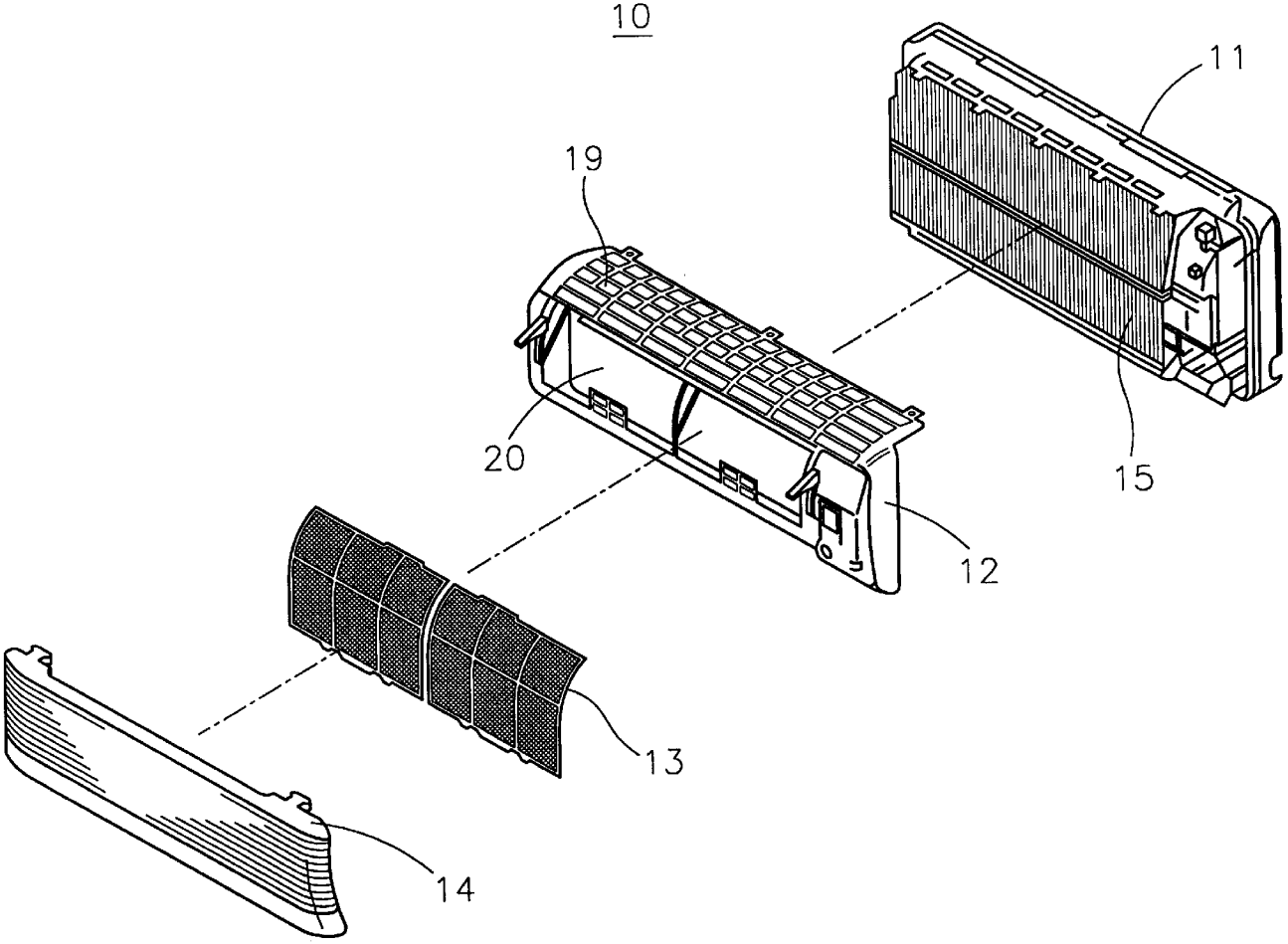
FIG. 1 (PRIOR ART)
FIG. 1 is an exploded perspective view of an indoor unit of an air conditioner in which a heat exchanger according to an embodiment of a conventional art is mounted.
Figure 2:
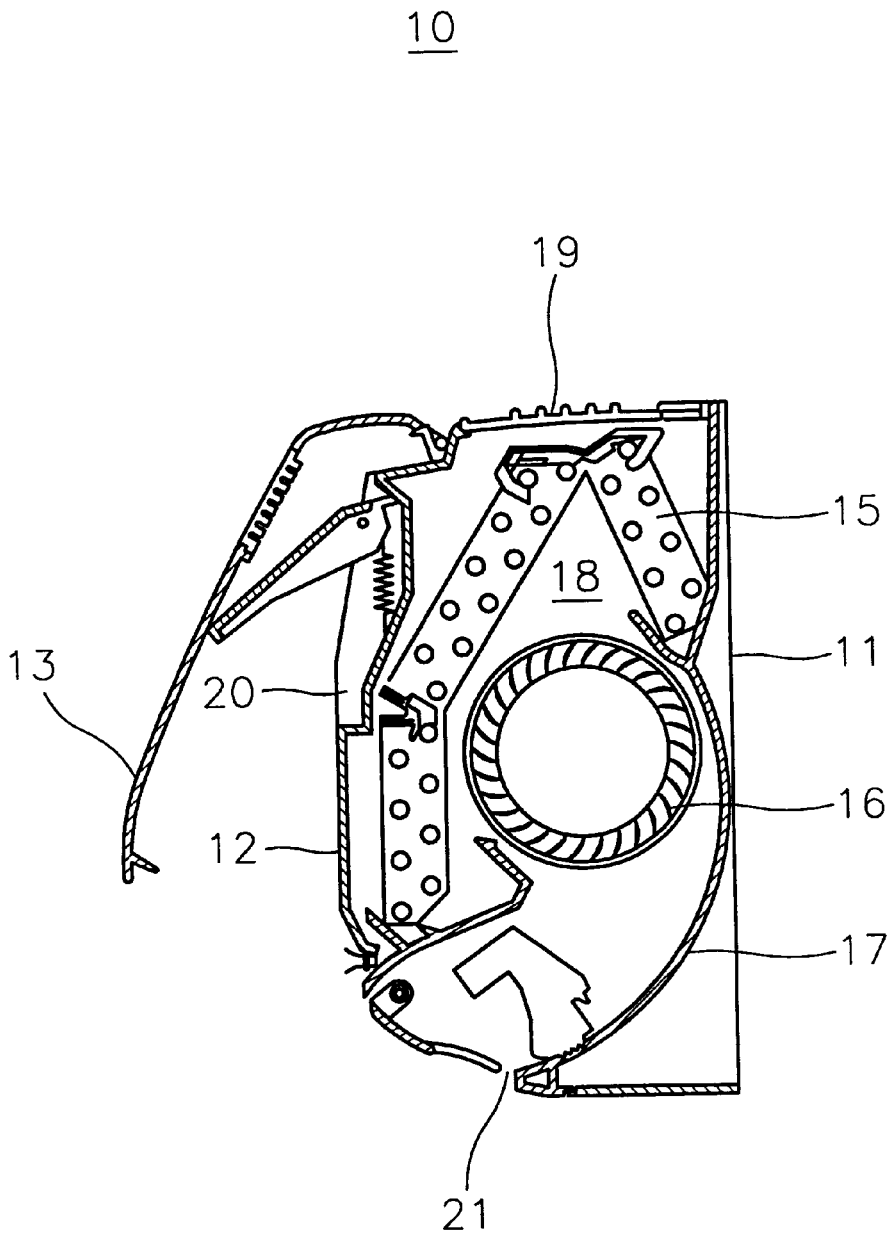
FIG. 2 (PRIOR ART)
FIG. 2 is a cross-sectional view of the indoor unit of the air conditioner in which the heat exchanger according to the embodiment of the conventional art is mounted.
Figure 3:
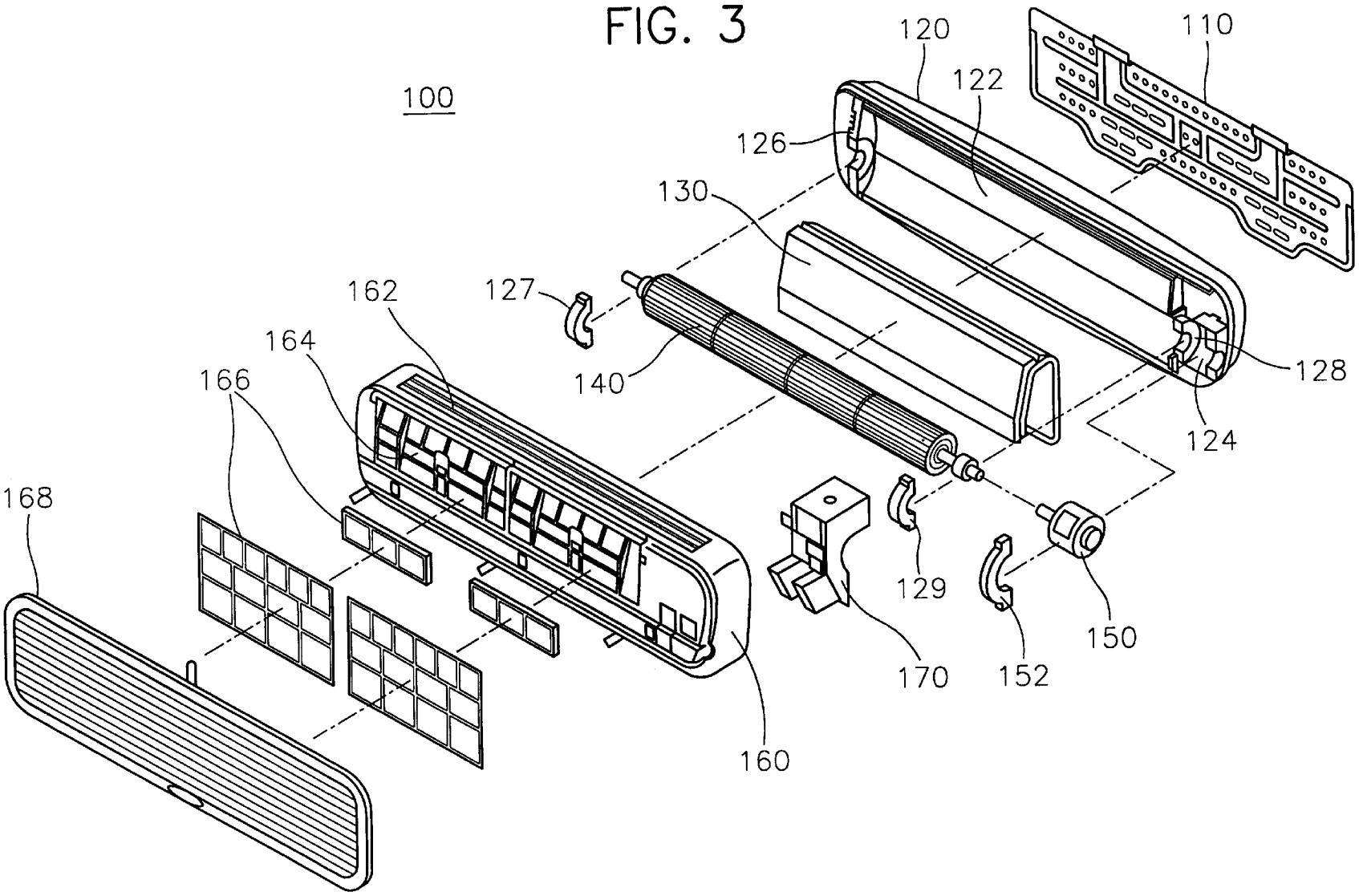
FIG. 3 is an exploded perspective view of an indoor unit of an air conditioner in which an heat exchanger according to an embodiment of a present invention is mounted.

FIG. 3 is an exploded perspective view of an indoor unit of an air conditioner in which a heat exchanger according to the embodiment of the present invention is mounted. Referring to FIG. 3, the indoor unit of the air conditioner according to the present invention includes a mounting plate 110 which is used for mounting the indoor unit 100 to a wall, a frame body 120 mounted on and secured to the mounting plate 110, a heat exchanger 130 which is disposed at an air pathway chamber 122 of frame body 120, for absorbing a heat from air in a room, a blower 140 which is disposed between a first fin assembly 132 of heat exchanger 130 and a wall portion of frame body 120, for sucking the air of the room into frame body 120 and for discharging the air passing through heat exchanger 130 and air pathway chamber 122, an electric motor 150 whose shaft is connected to a shaft of blower 140, for rotating blower 140, and a grille frame 160 which is connected to frame body 120, for comprising air inlets 162 and 164 for sucking the air, an air outlet (not shown) for discharging the air, and a filter assembly 166 and a grille 168 for filtering dust from the air in the room.

The mounting plate 110 is used for mounting indoor unit 120 of the air conditioner to the wall of the room. A plurality of stud bolts are installed in the wall of the room. A plurality of thruholes are perforated in an upper portion and a lower portion of mounting plate 110. Furthermore, at least two latches are formed at an upper edge of mounting plate 110. The latches are spaced apart from each other by a predetermined distance and extend upward after the latches are extended from the upper edge of mounting plate 110 and are bent. After stud bolts are inserted into the thruholes of mounting plate 110 to extend through the thruholes, the nuts are engaged with the stud bolts so that mounting plate 110 is attached to the wall in the room. And then, the latches of mounting plate 110 are inserted into grooves formed at a rear surface of the wall portion of frame body 120 in indoor unit 100 so that indoor unit 100 can be mounted at the wall in the room.

The air pathway chamber 122 is defined at the center portion of frame body 120 of indoor unit 100 by the wall portion of frame body 120 and grille frame 160. Partitions are formed at positions adjacent to both sides of frame body 120, respectively. A semi-circular groove is formed in the center portion of each partition, and a bearing is disposed in the semi-circular groove. A receiving chamber 124 is formed at a side portion of frame body 120 to receive electric motor 150 rotating blower 140. Bearings are mounted on the opposite ends of the shaft of blower 140, respectively, and the rotating shaft of electric motor 150 is mounted on an end of the shaft of blower 140. After blower 140 is disposed at air pathway chamber 122 so that the bearings respectively mounted on the opposite ends of blower 140 are disposed in each groove formed in partitions 126 and 128 and electric motor 150 is disposed in electric motor receiving chamber 124, bearing holders 127 and 129 are engaged with partitions 126 and 128 to secure the bearings, and electric motor holder 152 is engaged with electric motor receiving chamber 124 to secure electric motor 150. A control box 170 is disposed at a front of electric motor 150 mounted on frame body 120.

Blower 140 sucks the air of the room through air inlets 162 and 164 of grille frame 160 into frame body 120, and discharges the air cooled by heat exchanger 130 through the air outlet formed at the lower portion of grille frame 160. Heat exchanger 130 is disposed over blower 140 in such a manner that blower 140 is enclosed together with first fin assembly 132, a second fin assembly 134, and the wall portion of frame body 120.

Grille frame 160 includes air inlets 162 and 164 at the upper portion and a front surface thereof, respectively. Furthermore, grille 168 is disposed at the front of grille frame 160. A filter assembly 166 is disposed between grille frame 160 and grille 168. Filter assembly 166 filters dust and alien substances from the air which is sucked through air inlets 162 and 164 formed respectively at the upper portion and grille 168 of grille frame 160 in indoor unit 100 of the air conditioner. A control panel of control box 170 is disposed at a position of the front surface of grille frame 160 and controls indoor unit 100.

Figure 4:
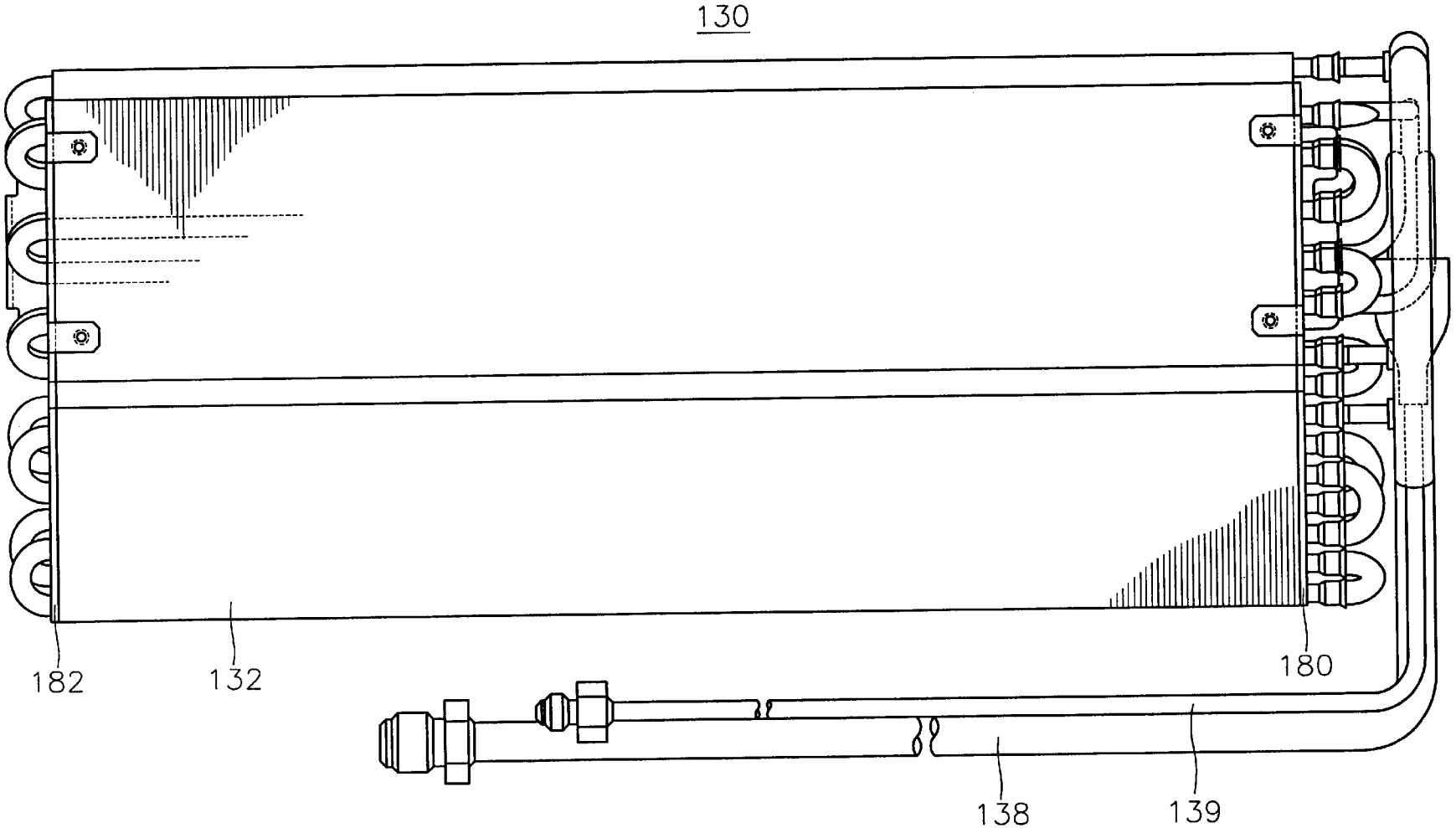
FIG. 4 is a front view of the heat exchanger according to the present invention.
Figure 5:
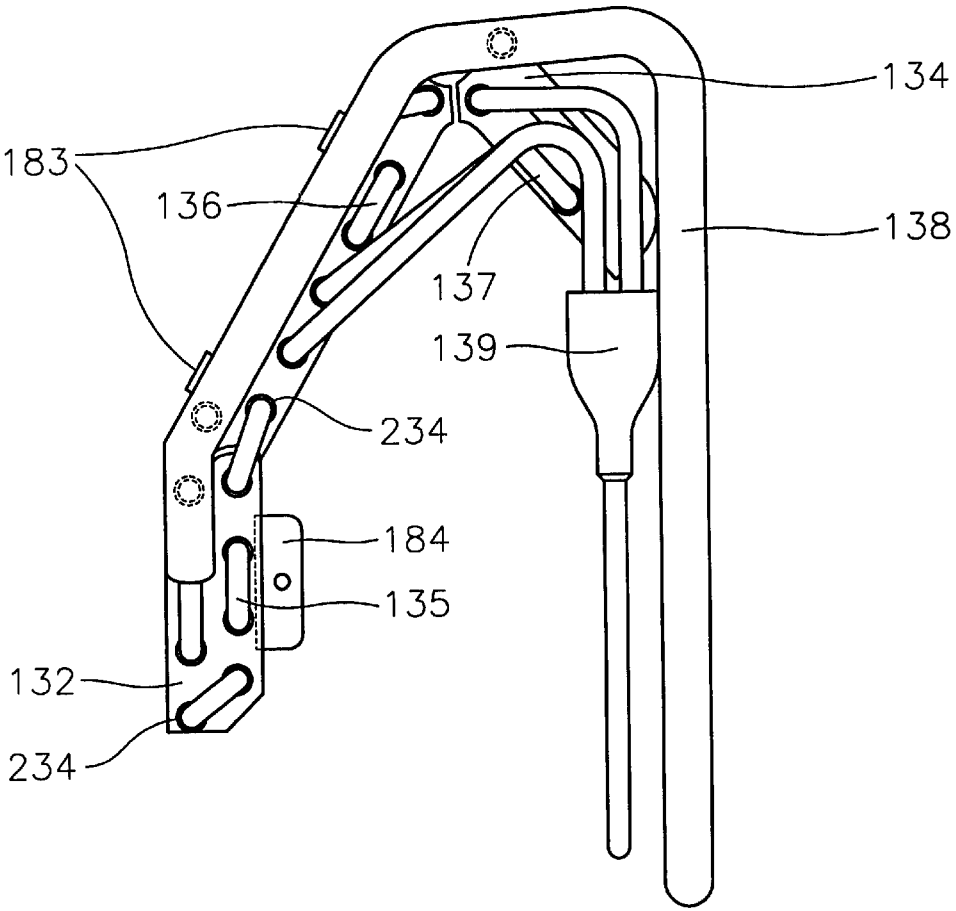
FIG. 5 is a side view of the heat exchanger according to the present invention.

FIG. 4 is a front view of heat exchanger 130 according to the embodiment of the present invention, and FIG. 5 is a side view of heat exchanger 130 of according to the embodiment of the present invention. Referring to FIGS. 4 and 5, heat exchanger 130 of indoor unit 100 of the air conditioner comprises first fin assembly 132 which is bent at a position adjacent to a lower end, for absorbing the heat from the air of the room, second fin assembly 134 which is adjacent to an upper end of first fin assembly 132 and spaced apart from first fin assembly 132 by a predetermined distance, for absorbing the heat from the air of the room, a first refrigerant pipe 135 which extends through a lower portion of first fin assembly 132 and connects fin plates of first fin assembly 132 to each other, for supplying a circulation pathway for refrigerant, a second refrigerant pipe 136 which extends through an upper portion of first fin assembly 132 and connects fin plates of first fin assembly 132 to each other, for supplying a circulation pathway for refrigerant, a third refrigerant pipe 137 which extends through second fin assembly 134 and connects fin plates of second fin assembly 134 to each other, for supplying a circulation pathway for refrigerant, a refrigerant supplying pipe 138 which is connected at a first end to refrigerant inlets of first, second, and third refrigerant pipes 135, 136, and 137, and is connected at a second end to an expansion valve, for supplying the refrigerant to first, second, and third refrigerant pipes 135, 136, and 137, a refrigerant discharging pipe 139 which is connected at a first end to refrigerant outlets of first, second, and third refrigerant pipes 135, 136, and 137, and is connected at a second end to the compressor, for discharging the refrigerant from first, second, and third refrigerant pipes 135, 136, and 137 to a compressor, and connecting members 180 and 182 which are secured at each side of first fin assembly 132 and second fin assembly 134, for connecting first fin assembly 132 and second fin assembly 134 with each other.

First fin assembly 132 and second fin assembly 134 are comprised of a plurality of fin plates, in which each fin plate is made of aluminum having a thickness of about 0.12 mm and a width of about 25 mm and has two row of thruholes formed therein in a zigzag. A cylindrical guide portion 234 extends from an edge of each thruhole to guide the refrigerant pipes, for example pipes made of copper. A plurality of fins being lower in height than the guide portions 234 are attached to the surface of each fin plate having the guide portions 234 formed thereon. When the air of the room which is sucked by blower 140 passes through heat exchanger 130, the air flows between fins attached to the fin plates. The fins attached to fin plates absorb the heat from the air and transmit the heat to the refrigerants flowing through first, second, and third refrigerant pipes 135, 136, and 137. Accordingly, the air which is sucked in air pathway chamber 122 is cooled and the refrigerants which flow through first, second, and third refrigerant pipes 135, 136, and 137 are evaporated.

First fin assembly 132 and second fin assembly 134 are separately made, and first fin assembly 132 is higher in height than second fin assembly 134. The fin plates which form first fin assembly 132 have a cut off portion where a width of about ⅗ is transversely cut at a position spaced apart from the lower end of the fin plates by a predetermined distance. In order to allow first fin assembly 132 to assemble with second fin assembly 134, the upper portion of first fin assembly 132 is bent at the cut off portion.

First, second, and third refrigerant pipes 135, 136, and 137 are made by connecting a plurality of first pipes and second pipes, which are copper pipes having a good heat transmission and bent in a U-shape. In a state that the first and second pipes are bent in the U-shape, a total length of the first pipes is larger than the width of first fin assembly 132 and second fin assembly 134. The second pipes are used for connecting the first pipes to each other.

Figure 6A:
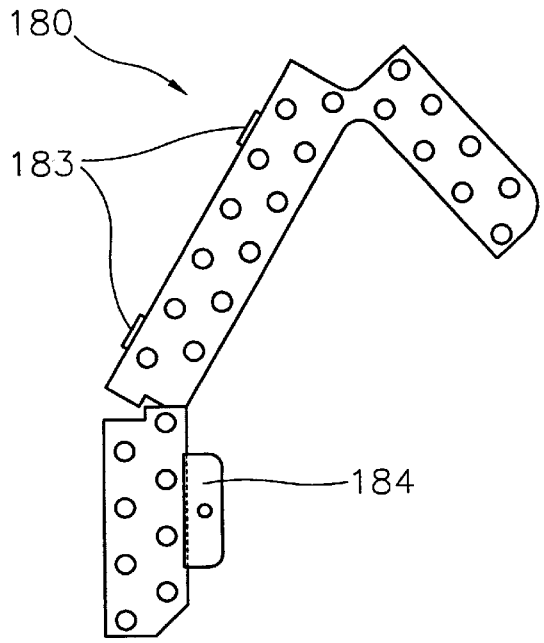
Figure 6B:
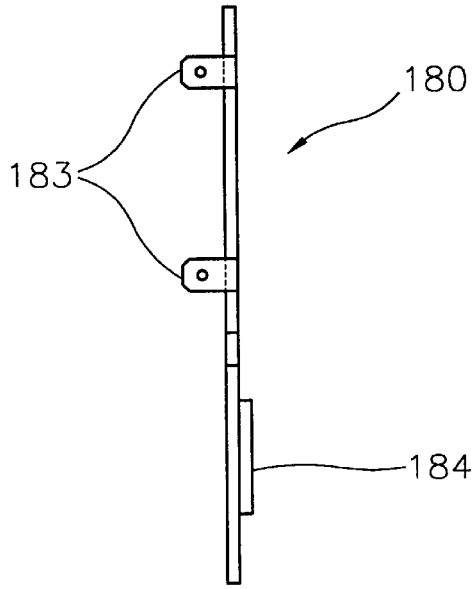

Referring to FIGS. 6A and 6B, connecting member 180 is made of a steel plate having a thickness of about 1 mm and having a width equal to that of the fin plates of first fin assembly 132 and second fin assembly 134. The lower portion of connecting member 180 is bent at the same angle as the bending angle of first fin assembly 132 at the same position as the bent position of first fin assembly 132, and the upper portion of connecting member 180 is bent at an acute angle to form an upside-down V-shape. Connecting member 180 has a plurality of extending portions 183 extending vertically to a surface of connecting member 180 from the first edge thereof and having a thruhole formed at the center portion. The plurality of extending portions 183 are secured to first fin assembly 132 so that connecting member 180 connects first fin assembly 132 and second fin assembly 134 to each other.

Furthermore, connecting member 180 has a fixing plate 184 attached to a second edge thereof and having a thruhole formed at the center portion thereof. The fixing plate is connected by a fixing member to frame body 120 of indoor unit 100 so that first fin assembly 132 and second fin assembly 134 are connected to frame body 120 of indoor unit 100. Connecting member 182 is in the shape of a mirror image of connecting member 180.

Refrigerant supplying pipe 138 is connected to an expansion valve at one end thereof, and is connected to refrigerant inlets of first, second, and third refrigerant pipes 135, 136, and 137 at a position adjacent to the other end thereof. Refrigerant discharging pipe 139 is connected to the compressor at one end thereof, and is connected to refrigerant outlets of first, second, and third refrigerant pipes 135, 136, and 137 at the other end thereof.

In order to assemble first fin assembly 132 and second fin assembly 134 forming heat exchanger 130, bending portions of the U shaped first pipes are disposed at a side. One of connecting members 180 and 182 is inserted from both ends of the first pipes toward the bending portions of the U shaped first pipes so as to connect the first pipes. The fin plates of first and second fin assemblies 132 and 134, respectively, are arranged in one direction and the both ends of first pipes are inserted into the plurality of the fin plates of first and second fin assemblies 132 and 134, respectively. The both ends of the first pipes are inserted in the other connecting member. And then, openings of both ends of the U shaped-first pipes are enlarged. Finally, each one end of the second pipes is inserted into each opening of one end of the first pipes and each other end of the second pipes is inserted into each opening of the other end of the first pipes so as to connect the first pipes and the second pipes by means of welding.

Hereinafter, the operation of each of the elements of the indoor unit of the air conditioner according to the embodiment of the present invention will be described.

In indoor unit 100 of the air conditioner including heat exchanger according to the present invention, in a state that the refrigerant, which is cooled and liquefied by the compressor of an outdoor unit, decreases in pressure and is atomized, the refrigerant flows into one end of refrigerant supplying pipe 138 connected to the expansion valve and flows along refrigerant supplying pipe 138. The refrigerant reaches the other end of refrigerant supplying pipe 138 and flows into first, second, and third refrigerant pipes 135, 136, and 137 through inlets thereof. The refrigerant flows along first, second, and third refrigerant pipes 135, 136, and 137. The air of the room which is sucked into indoor unit 100 flows between fin plates of first fin assembly 132 and second fin assembly 134 of heat exchanger 130. At this time, first fin assembly 132 and second fin assembly 134 of heat exchanger 130 absorb the heat from the air of the room flowing between the fin plates thereof and transmits the heat to the refrigerant flowing along first, second, and third refrigerant pipes 135, 136, and 137, which extend through first fin assembly 132 and second fin assembly 134. Thus, the refrigerant is evaporated and flows through outlets of first, second, and third refrigerant pipes 135, 136, and 137 toward refrigerant discharging pipe 139. The evaporated refrigerant flows into the compressor of the outdoor unit and is compressed adiabatically. Then the compressor discharges the heat from the refrigerant so that the refrigerant is cooled again. The cycles as described above are repeated and the temperature of the room decreases, thereby achieving the cooling of the room.

As described above, in the heat exchanger of the indoor unit of the air conditioner according to the present invention, there is an advantage in that the first fin assembly and the second fin assembly are separately made and are connected by the connecting means to each other so that it is easy to make the heat exchanger and a length of the manufacturing process thereof can be reduced with respect to a bending process according to the conventional art.

Furthermore, there is an other advantage in that since a heat exchanging area of the heat exchanger is enlarged and an efficiency of the heat exchanger is increased, a total refrigerating efficiency of the air conditioner can be improved.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A heat exchanger for an indoor unit of an air conditioner comprising:

a first fin assembly which is bent at a position adjacent to a lower end thereof, for absorbing heat from air of a room;

a second fin assembly which is adjacent to an upper end of the first fin assembly and spaced apart from the first fin assembly by a predetermined distance, for absorbing heat from air of the room;

a first refrigerant pipe for supplying a circulation pathway for refrigerant, the first refrigerant pipe extending through a lower portion of the first fin assembly and connecting fin plates of the first fin assembly with each other;

a second refrigerant pipe for supplying a circulation pathway for refrigerant, the second refrigerant pipe extending through an upper portion of the first fin assembly and connecting fin plates of the first fin assembly with each other;

a third refrigerant pipe for supplying a circulation pathway for refrigerant, the third refrigerant pipe extending through the second fin assembly and connecting fin plates of the second fin assembly with each other;

a refrigerant supplying pipe for supplying the refrigerant to the first, the second, and the third refrigerant pipe, the refrigerant supplying pipe being connected at a first end to refrigerant inlets of the first, the second, and the third refrigerant pipes and being connected at a second end to an expansion valve;

a refrigerant discharging pipe for discharging the refrigerant from the first, the second, and the third refrigerant pipes to a compressor, the refrigerant discharging pipe being connected at a first end to refrigerant outlets of the first, the second, and the third refrigerant pipes and being connected at a second end to the compressor; and a connecting means for connecting the first fin assembly and the second fin assembly with each other, the connecting means including a steel plate having a shape identical to shapes of the first and second fin assemblies, the connecting means having a thickness of 1 mm and being secured to both sides of the first fin assembly and the second fin assembly for connecting the first and second fin assemblies to each other, wherein a lower portion of the connecting means is bent at a position corresponding to a bending position of the first fin assembly and an upper portion of the connecting means is bent at an acute angle to form an upside down V shape, and the connecting means includes a plurality of extensions extending vertically to a surface of the connecting means from a first edge thereof and having a thruhole formed at a center portion thereof, the extension being secured to the first fin assembly.

2. A heat exchanger for an indoor unit of an air conditioner as claimed in claim 1, wherein the connecting means further comprises a fixing plate attached to a predetermined position of a second edge thereof, the fixing plate having a thruhole formed at a center portion thereof, the fixing plate being secured to a body of the indoor unit so that the first fin assembly and the second fin assembly are secured to the body of the indoor unit.

3. A heat exchanger for an indoor unit of an air conditioner as claimed in claim 1, wherein the connecting means has a plurality of thruholes equal in number to a number of thruholes formed in each fin plate of the first fin assembly and the second fin assembly, and wherein a center axis of each thruhole is coincident with a center axis of each thruhole formed in each fin plate.

4. A heat exchanger for an indoor unit of an air conditioner as claimed in claim 1, wherein the first fin assembly and the second fin assembly are comprised of a plurality of fin plates which respectively have a thickness of 0.12 mm and a width of 25 mm, have two row of the thruholes formed in a zigzag manner, and have a cylindrical guide portion protruding vertically to a surface thereof from an edge of each thruhole, the guide portion guiding the first, the second, and the third refrigerant pipes.

5. A heat exchanger for an indoor unit of an air conditioner as claimed in claim 4, wherein the first fin assembly and the second fin assembly are made separately, and the first fin assembly is higher in height than the second fin assembly.

* * * * *